United States Patent [19]

Gibbons

[11] Patent Number: 4,940,394

[45] Date of Patent: Jul. 10, 1990

[54] ADJUSTABLE WEARPLATES ROTARY PUMP

[75] Inventor: Gordon H. Gibbons, Penryn, Calif.

[73] Assignee: Baker Hughes, Inc., Houston, Tex.

[21] Appl. No.: 259,079

[22] Filed: Oct. 18, 1988

[51] Int. Cl.[5] ..... F04B 49/00; F04C 2/00

[52] U.S. Cl. ..... 417/283; 418/134; 418/135; 418/206

[58] Field of Search ..... 417/283; 418/206, 135, 418/205, 134

[56] References Cited

U.S. PATENT DOCUMENTS

| | | | |
|---|---|---|---|
| 2,134,153 | 10/1938 | Seyvertsen | 418/135 |
| 3,817,667 | 6/1974 | Winkelstrater | 418/206 |
| 4,370,110 | 1/1983 | Nagely | 418/135 |

FOREIGN PATENT DOCUMENTS

| | | | |
|---|---|---|---|
| 1106604 | 4/1955 | Fed. Rep. of Germany | 418/135 |
| 386150 | 1/1972 | U.S.S.R. | 418/135 |

*Primary Examiner*—Leonard E. Smith
*Assistant Examiner*—John A. Savio, III
*Attorney, Agent, or Firm*—Skjerven, Morrill, MacPherson

[57] ABSTRACT

A rotary lobed rotor pump has externally adjustable wearplates in the rotor casing juxtaposed to the parallel ends of rotating lobed rotors. Resilient members such as Belleville springs are adjusted by compression by means external of the rotor casing so that the springs move the wearplate(s) into a design clearance with the parallel rotor ends. No pump disassembly is required to accurately set the clearance. An internal pressure surge by-pass is provided which permits outward movement of either or both wearplates resulting in an increased gap with the rotor ends causing a decrease in the rate of rise in fluid pressure in the internal rotor casing cavities in effect causing rotor slippage.

5 Claims, 3 Drawing Sheets

ADJUSTABLE WEARPLATES ROTARY PUMP

FIELD OF THE INVENTION

The present invention relates generally to rotary gear pumps, more particularly to wear plates and pressure bypass improvements to a positive displacement lobe-type gear pump.

BACKGROUND OF THE INVENTION

Lobe-type rotary pumps are useful in pumping both thin and highly viscous products. Operation of lobe-type rotary pumps involves entry of the product into a suction port where it is gently drawn into pockets formed between rounded rotor lobes and the rotor case. The lobes push the product 180° C. around the interior of the curved contour of the case and out the discharge port. Each rotor equipped normally with two or more lobes moves in an opposite direction around parallel displaced axes to provide a smooth, uniform flow of product. Rounded lobes have no sharp cutting edges so that delicate handling of products with particles in suspension can be done while minimizing shear damage. The tolerances and timing actions are such that wear to pump parts is critical to efficient operation. Further, pumps of this type are subject to gradual or sudden surges which may block or back-up the flow being pumped by the rotating lobes.

In the prior art of rotary pumps generally such as a single shaft drive gerotor or vane design, provisions have been made to provide an overpressure relief function. U.S. Pat. No. 3,655,299 is pertinent to the very broad concept of an internal bypass function of a pump wherein a front plate includes a Belleville spring to bias the plate against an edge of an inner one of concentric pump rotors. When the pump fluid pressure exceeds a maxmium amount, the pressure force acting on the plate exceeds the bias force of the spring, moving the plate away from the rotor edge and allows fluid to flow from one chamber to the other chamber effectively stopping pumping action. As pressure subsides, the plate again is urged against the one rotor edge closing the gap clearance and normal pumping action resumes. A wearplate function is not stated.

Other pressure bypass constructions are seen in U.S. Pat. Nos. 3,806,283 (diaphragm moving away from chamber slots); in 4,336,004 and 4,398,871 (sensor and control valve with end plate movement); and 4,408,963 (bypass flow back to inlet to give constant rate of fluid flow to the system).

SUMMARY OF THE INVENTION

The present invention provides for at least one wearplate which normally seals the juxtaposed parallel ends of the lobed rotors of a rotary lobe pump and which is adjustable in clearance therebetween. This adjustment is performed essentially externally of the pump casing so that no pump disassembly is required to accurately set or adjust the clearance between the wearplate and the rotor ends. This not only saves disassembly and reassembly time but allows adjustment by operating personnel of less skill who possibly are not capable of performing the detailed steps of disassembly and reassembly.

The rotary lobe pump of this invention may be generally described as a pump having two identical rotors, both of which are driven and timed, each supported by a shaft and an included bearing, or bearings, which can be mounted inboard alone, or inboard and outboard of the rotors.

The performance of this type of pump is dependent on a close clearance between the rotor ends and wearplate/faceplate. Without a close clearance, fluid from the high pressure area on the discharge side of the pump could "slip" by the clearance between the rotor and wearplate/faceplate thereby reducing efficiency and limiting the discharge pressure of the pump. The purpose of this invention, therefore, is to produce a structure and describe a method of maintaining this critical clearance, as well as to include an internal bypass feature which takes advantage of this clearance for safety purposes.

None of the prior art patents cited above include a wearplate adjustment feature, let alone an adjustment which is operable from the exterior of the rotor casing.

In a preferred embodiment of the invention a front wearplate, i.e. closest to the outboard side of the rotor casing opposite the rotor drive mechanism, is spring loaded by Belleville washers or other tensioning device so that it is immediately juxtaposed to the front ends of the two rotors. The Belleville washers or tensioning device is preloaded to a set tension by a wearplate retained nut so that the wearplate is thus preloaded at a tension that correlates to a selected operating pressure for the pump. At a pump operating pressure, adjusting lugs exterior of the pump casing are screw turned so that the wearplate just touches the face of the rotor ends, without sufficient force or tightness such that the motor load driving the rotors is increased from drag of the rotors against the wearplate. Similar adjustment can be made with respect to a wearplate juxtaposed to the opposite or rear end of the rotors.

The internal pressure relief feature of the invention operates as follows. As the pressure increases either gradually or due to a surge in the pump cavities the Belleville springs or other tensioning device see this increase in load and compress proportionately allowing an increase in clearance between the rotor and the wearplate(s). This clearance allows slurry or other pumped material to cross from the pressure side of the rotor to the intake side or low pressure side causing a decrease in the rate of pressure rise. If a surge in the flow rate or a temporary blockage caused the pressure surge, then when the problem clears, the force from the compressed Belleville springs pushes the wear plate(s) back against the face of the rotor ends at the required clearance.

A construction is provided which allows the critical running clearance between the rotor ends and wearplate/faceplate to be maintained by means of an easy, convenient, external adjustment. There is no pump disassembly or other adjustments required to do this other than the simple adjustment of the external adjusting screws. The benefits of the preloading devices are the same as described for the adjustable wearplates; plus, the added benefit of being able to relieve surge or gradually increasing pressure and yet revert to the normal operation once the surge has cleared. With proper selection of the tensioning device utilized to preload the wearplate, the pump can be made to operate as a constant pressure, variable flow device. The benefit of this feature is that it would protect any equipment or device downstream of the pump from an overpressure surge.

DETAILED DESCRIPTION

Figure 1:
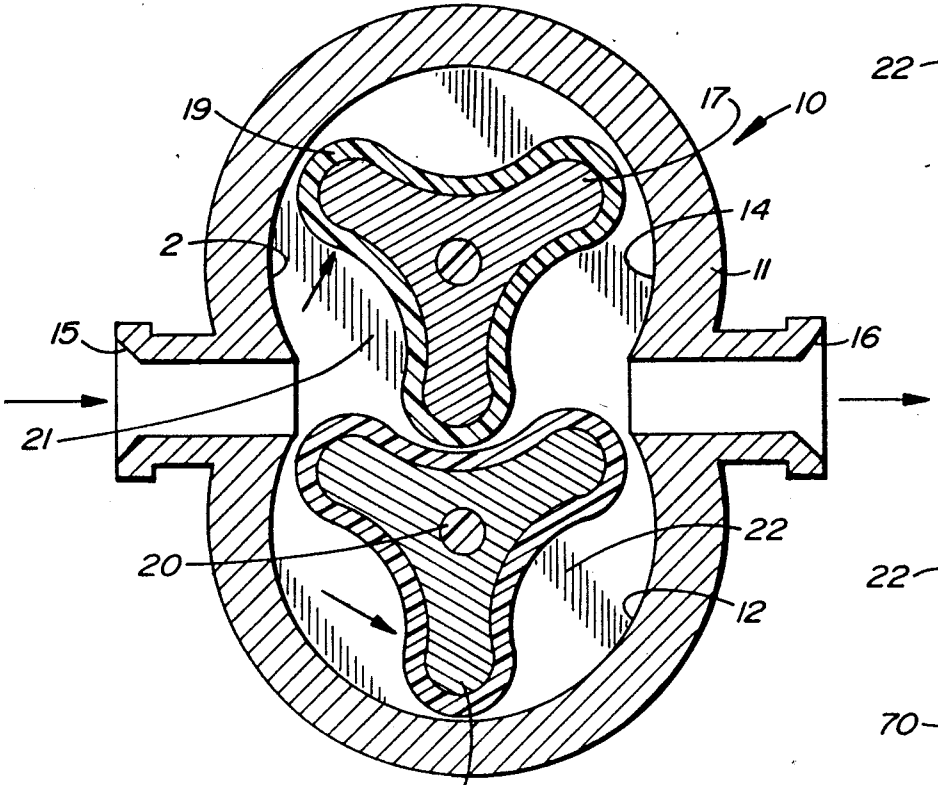
FIG. 1 is a schematic cross-sectional interior end view of the lobed rotary pump.

As seen in FIG. 1 the rotary pump 10 comprises a rotor casing 11 typically of ductile iron having a pair of displaced generally semi-cylindrical facing internal cavities 12, 14; a suction inlet port 15; a discharge port 16; first and second lobed rotors 17, 18, journalled in the casing and rotatable about axial shafts 20, interfitting with one another in rolling contact to form pumping pockets 21 between a radial inner portion of each lobe and an interior wall 2 of the cavities; and a wearplate 22 in close clearance with parallel ends of the rotors 17, 18 and movably and adjustably sealed to the ends of cavities 12, 14.

Figure 2:
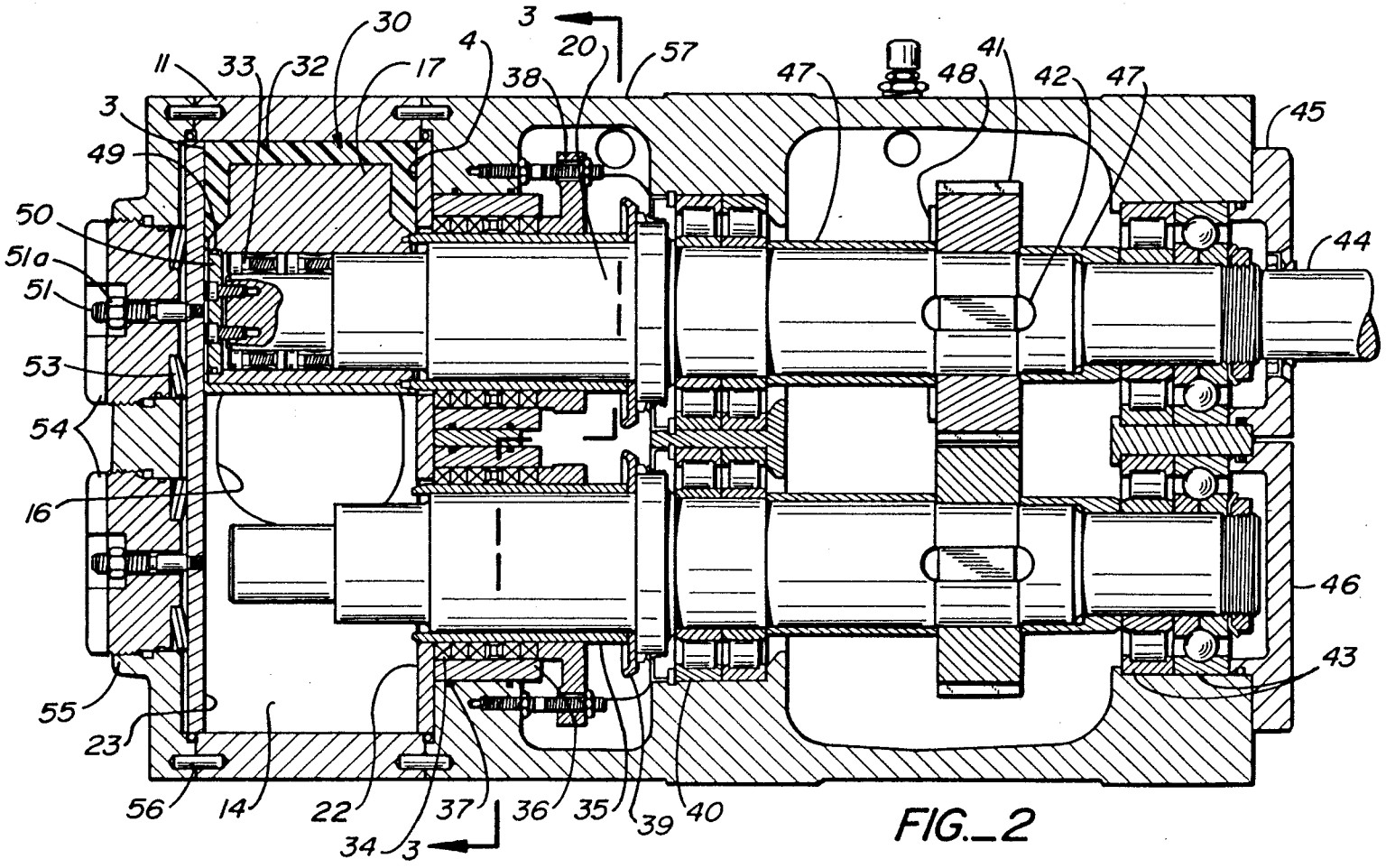
FIG. 2 is a cross-sectional side view of a first detailed embodiment of the overall rotary pump incorporating the invention.

FIG. 2 shows a cross-sectional view across the overall pump (less motor) orthogonal to the schematic view shown in FIG. 1 and including wearplates extending on opposite sides of the rotor cavities. A rotor assembly 30 comprises lobed rotors 17, 18 (one lobe of rotor 17 only being shown in cross section) keyed by a locking assembly 33 to and rotatable with shafts 20. Each rotor may be of solid metal or have a metal (steel) core covered by an elastomeric wear coating 32 such as urethane or rubber. An inboard (rear) wearplate 22 made from a 400 series stainless steel such as 410 stainless, or a high chrome iron (ASTM A 532 Class 3) casting or other abrasion-resistant material is juxtaposed with suitable design clearance with the ends of both rotors particularly with the wear coating 32 on each rotor. An outboard (front) wearplate 23 of similar material as wearplate 22 is juxtaposed with suitable design clearance with the opposite ends of the rotors. Rotor case 11 is connected to gear case 57 by suitable stainless steel hinge pins. Suitable seal packing 34, a shaft sleeve 35, and stuffing box sleeve 36 with o-rings 37 are provided to seal the gear case cavities around the rotating shafts 20. A packing gland 38 and urethane plastic slinger 39 complete the seal assembly. Gland 38 is made of two stainless steel halves and is part of a packing cartridge. Slinger 39 made of urethane plastic is part of the oil seal arrangment. Cylindrical roller bearings 40 support the rotor shafts. Timing gears 41 driving and follower fixed to the shafts by keys 42 assure the relative opposite rotation of the respective shafts. Bearings 43 support the inner ends of shafts 20. The end 44 of the upper shaft is connected to a motor shaft (not shown) which drives the shafts 20 and the rotor assemblies 30. Bearing caps 45, 46 seal the upper shaft bearing and the lower shaft bearing. Appropriate inboard and outboard spacers 47, and snap ring 48 are provided to properly space the gears 41.

In the commercial embodiment shown in FIG. 2 a rotor end cover 50 is provided at the outside end of the rotor inside the hub, the outer peripheral edge of the end cover being sealed in the rotor bore by o-ring 49. The outer wearplate assembly 23 is adjusted to a design clearance with the rotor ends 3 including the rotor end cover 50. Adjustment of wearplate assembly 23 is performed while the pump is either at rest or at operating pressure by screwing in the pre-loaded wearplate assembly adjustment lugs 54 into the housing 55 thereby moving the assembly to the design clearance against the face or ends of the rotors 17, 18. A rotor case cover 55 is connected to the rotor case by hinge pins 56, and covers the wearplate and forms the overall outboard closure of the rotor case.

The wearplate assembly is adjusted to a design preload by screwing the adjusting lugs 54 clockwise to a zero clearance between the adjusting lugs 54, Belleville springs 53, wearplate 23, and the rotor faces 3. The preload is then set by turning the adjusting lugs 54 clockwise an additional number of turn/turns compressing the Belleville springs to a predetermined design force (in pounds). For example, in a pump having a 30 psi operational pressure the Belleville springs are set so they have a spring load for a 33 psi by-pass pressure. When associated with a wearplate having a 100 $in^2$ surface area facing the pump cavity the total force compressing the springs will be 3300 pounds. Subsequent movement of the wearplate as described as to FIG. 4*a* to the design clearance of from about 0.001 to about 0.005 inches will increase the by-pass pressure to about 35 psi. Thus it is seen that the design force is dependent on the size of the wearplate face and the particular compression of the by-pass Belleville springs.

The design clearance between the wearplate 23 and the rotor faces 3 and the additional preload is obtained by tightening the wearplate stud nuts **51*a* clockwise on the wearplate studs 51, adding additional compression to the Belleville spring 53 and pulling the wearplate 23 away from the rotor faces 3** to a predetermined design clearance.

The internal pressure bypass functions as follows: As the fluid pressure increases in cavities 22, caused by a surge in pressure and/or a gradual increase in pressure the force on the outboard wearplate 23 is increased. The Belleville type spring washers 53, or other pressure loading device, see this increase in load and compress proportionally, allowing the clearance between the ends 3 of the rotors in assembly 30 and the wearplate 23 to increase. The clearance slot thus created, allows fluid to flow from the high pressure discharge side of the rotors to the low pressure inlet suction side of the rotors, causing a decrease in the rate of rise of the fluid pressure in the cavities. In effect, the rotors would be slipping. If a surge in flow rate or a temporary blockage caused the pressure increase, then as the problem clears, the force from the compression device, i.e., the restorative force of the Belleville springs, will force the wearplate to just touch or float against the rotor faces, thus reverting to their original "zero" clearance and/or adjusted clearance setting.

Figure 4A:
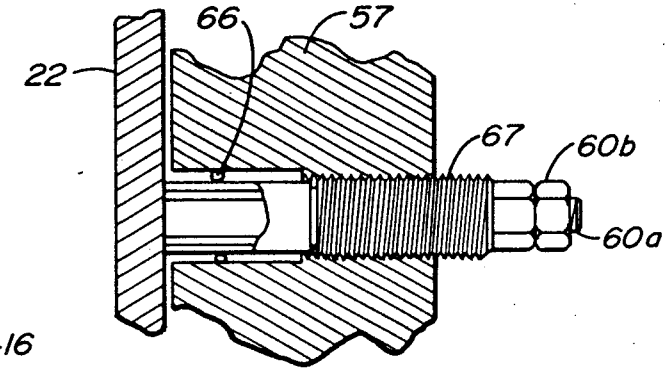
FIG. 4*a* is a detail side view of the inbroad wearplate exterior adjustment means taken on the line 4—4 of FIG. 3.
Figure 4B:
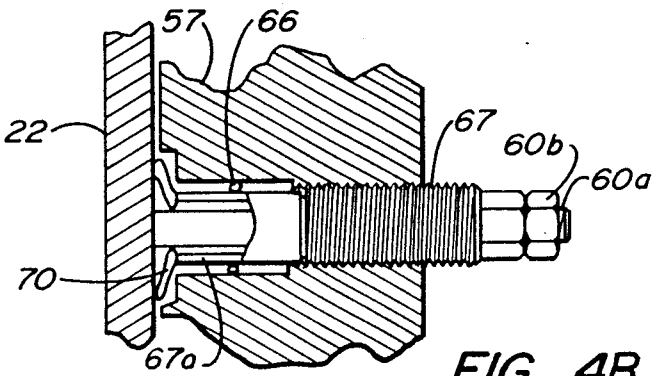
FIG. 4*b* is a side view of a modification of the FIG. 4*a* design but showing an additional bypass function.
Figure 3:
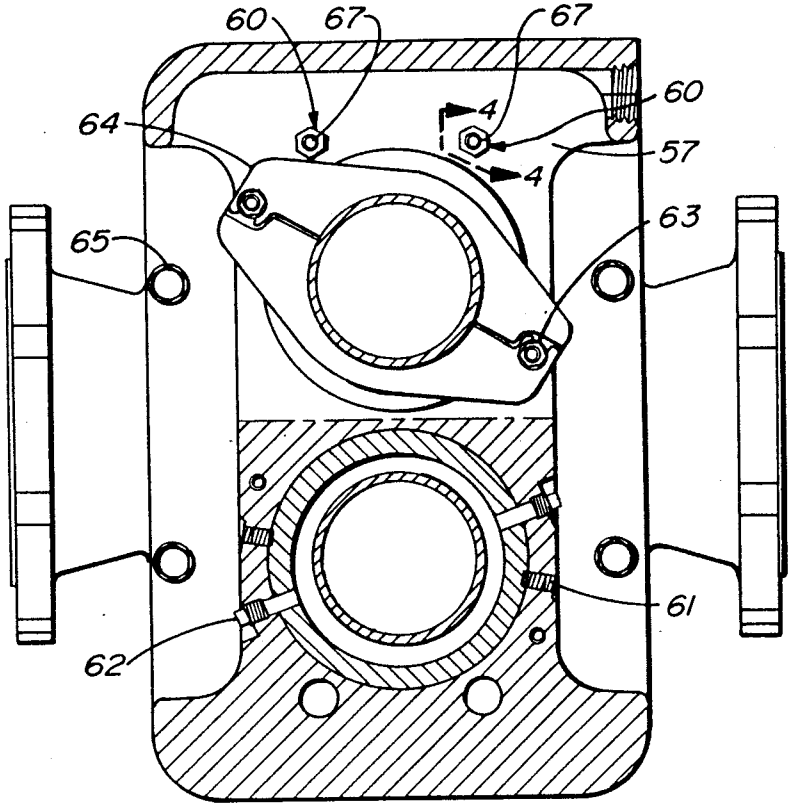
FIG. 3 is a cross-sectional view of the overall rotary pump taken on the line 3—3 in FIG. 2.

Similarly the inboard wearplate 22 can incorporate the full embodiment of the bypass function or be adjustable without the bypass function as shown in FIG.3 and FIG. 4*a* or include a bypass capability as shown in FIG. 4*b*.

FIG. 3 illustrates the exterior accessibility of the inboard wearplate adjusting screw assembly 60 and 67.

As most clearly seen in FIG. 4*a* screws 67 pass through the gear case 57 and have ends which seat either directly on the rear face of wearplate 22 or against Belleville springs 70 (FIG. 4*b*) which are interposed between the wearplate 22 and the adjusting screws 67. As seen in FIG. 4*a*, the adjusting screws 67 have external threads which are threaded into the gear case 57 and over threaded wearplate stud 60*a*. The screws 67 are moved inwardly against the wearplate 22, pushing the wearplate toward the rotor faces 4 (FIG. 4) to a design clearance typically of about 0.001 inches to about 0.005 inches or adjusted outwardly to pull the wearplate away from the rotor face 4 to a design clearance. For both cases the lock nut 60*b* is tightened on the wearplate sutd 60*a* to lock the wearplate to the end of the adjusting screw 67 or to a preset load against the Belleville spring 70. In the emdodiment of FIG. 4*b* , the inner end of collar 67*a* pushes against and compresses Belleville spring 70 to effect the design clearance. O-rings 66 provide a seal between the gear case and adjusting screw 67. The position of the rotor-facing surface of the wearplate 22 is adjusted to design clearance with the rotor ends 4 of rotors 17, 18.

FIG. 3 also illustrates a stuffing box retainer screw 61, a pipe plug 62 for a seal water flush, packing gland halves 38, gland connection bolts and nuts 63, and rotor case connecting bolts 65.

Figure 5:
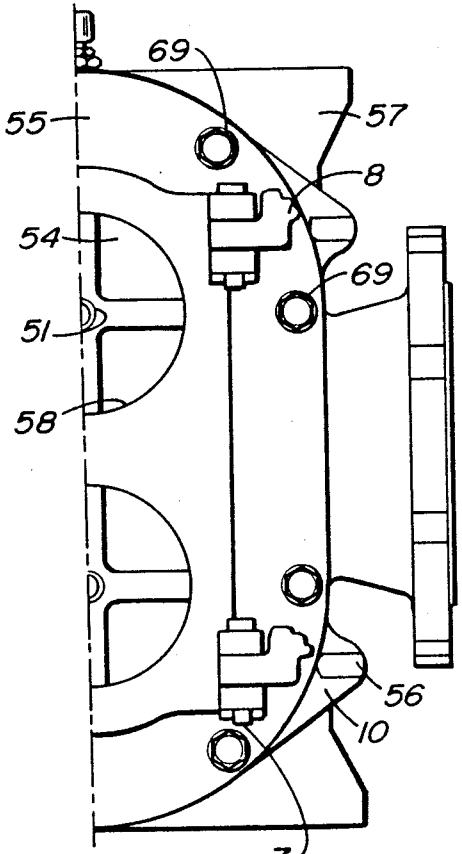
FIG. 5 is a half-end view of the rotary pump showing the exterior adjustment means for the outboard wearplate.

FIG. 5 illustrate the exterior front end of the rotary pump where the rotor cover 55 is hinged by pins 7 to hinge links 8 extending from the hinge support 56 and the rotor case 10. The rotor case cover is opened by removing the bolts 69 and swining the door assembly open on the hinge links 8. Adjustment of the lugs 54 are made through an aperture 58 in the face of cover 55.

The above description of embodiments of this invention is intended to be illustrative and not limiting. Other embodiments of this invention will be obvious to those skilled in the art in view of the above disclosure.

I claim:

1. A rotary pump comprising:

a rotor casing having a pair of displaced semi-cylindrical facing cavities therein, a suction inlet port and a discharge port;

a first lobed rotor journalled within said casing and rotatable in one of said cavities;

a second lobed rotor identical to said first lobed rotor and journalled within said casing and rotatable in the other of said cavities, said lobed rotors interfitting to form pumping pockets between portions of said rotors and said casing, said pockets being movable from adjacent said inlet port to adjacent said discharge port;

means for rotatably driving said rotors in opposite directions;

a first wearplate in close clearance and in juxtaposition with parallel faces of said rotors and sealing one end of said cavities; and means for adjusting the clearance of said first wearplate with said rotor faces, said adjusting means being operable from the exterior of said rotor casing and comprising:

a pair of rotatably adjustable lugs extending from said rotor casing;

compression spring means positioned between an inner end surface of said lugs and an outer surface of said first wearplate for compressively loading said first wearplate;

a pair of spaced threaded studs connected to and extending outwardly from said outer surface of said first wearplate, one of said studs extending juxtaposed to one of said lugs and the other of said studs juxtaposed to the other of said lugs; and a stud nut on each of said threaded studs, such that said lugs are adjustable to preload said spring means to a set tension correlating to a selected pump operating pressure and wherein at said pump operating pressure tightening of said nuts adds additional compression to said spring means and pulls said first wearplate away from said rotor faces to a predetermined design clearance.

2. The rotary pump of claim 1 comprising a second wearplate in close clearance with opposite parallel faces of said rotors and sealing an opposite end of said cavities.

3. The rotary pump of claim 2 including second means for adjusting the clearance of said second wearplate, said second means being operable from the exterior of said rotor casing.

4. The rotary pump of claim 1 wherein said springs means is further compressible and the clearance between said first wearplate and said juxtaposed parallel rotor faces is increased upon an increase in pump pressure in said cavities, whereby internal cavity pressure and material being pumped is by-passed through said increased clearance to said inlet port.

5. The rotary pump of claim 1 in which said spring means comprises a series of Belleville springs.

* * * * *